US006129149A

United States Patent [19]

Beall

[11] Patent Number: 6,129,149

[45] Date of Patent: Oct. 10, 2000

[54] WELLHEAD CONNECTOR

[75] Inventor: Scott K. Beall, Houston, Tex.

[73] Assignee: Kvaerner Oilfield Products, Houston, Tex.

[21] Appl. No.: 09/001,287

[22] Filed: Dec. 31, 1997

[51] Int. Cl.[7] ..... E21B 33/03; E21B 33/038

[52] U.S. Cl. ..... 166/344; 166/365; 166/368

[58] Field of Search ..... 166/344, 340, 166/345, 359, 365, 368

[56] References Cited

U.S. PATENT DOCUMENTS

| | | | |
|---|---|---|---|
| 3,739,846 | 6/1973 | Beson | 166/89 |
| 3,965,977 | 6/1976 | Beson | 166/88 |
| 4,433,859 | 2/1984 | Driver et al. | 285/34 |
| 4,526,406 | 7/1985 | Nelson | 285/18 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,852,611 | 8/1989 | Knett et al. | 137/595 |

FOREIGN PATENT DOCUMENTS

| | | |
|---|---|---|
| 2097885 | of 0000 | United Kingdom . |
| 2132728 | of 0000 | United Kingdom . |
| 2184508 | of 0000 | United Kingdom . |
| 2195158 | of 0000 | United Kingdom . |

*Primary Examiner*—George Suchfield
*Attorney, Agent, or Firm*—Wendy Buskop; Buskop Law Group

[57] ABSTRACT

A connector device for connecting a wellhead christmas tree assembly to a wellhead wherein the device comprises a cylindrical body adapted to be placed in sleeved relationship to the wellhead and having means for attaching a wellhead christmas tree assembly in coaxial relation therewith. The cylindrical body member is further provided with a plurality of lateral openings in equiangular relationship with respect to the axis of the body member. The connector further includes a plurality of locking dogs, each having a toothed front face in conforming configuration with the wellhead exterior and each disposed in a different one of the lateral openings. The connector also includes a first drive means comprising a locking sleeve with an internal camming surface for interacting with a matching cam surface on the back face of each of the locking dogs and adapted by an actuator to drive the locking dogs into locking engagement with the wellhead. The taper of the matching cam surfaces is sufficiently small such that when the drive force is removed, the locking dogs remain in their locking condition. The device also includes a second drive means for forcibly moving the locking dogs away from the wellhead to disconnect from the wellhead where a disconnect is desired.

13 Claims, 7 Drawing Sheets

WELLHEAD CONNECTOR

FIELD OF THE INVENTION

The invention relates to a connector device, and more particularly to a connector for connecting a wellhead christmas tree assembly to a wellhead.

BACKGROUND OF THE INVENTION

Wellhead christmas tree assemblies require secure, leak proof connections to the upper end of the wellhead and the connecting means should allow for quick installation of the wellhead christmas tree and its quick and easy removal. Conventional wellhead connectors typically include a locking mechanism, an actuator for the locking mechanism, and complex means for maintaining the connector in the locked condition once the actuating force is removed. It is also desirable that the connecting means preclude conventional well operations from loosening or retracting the connector's latching mechanisms from the wellhead. Furthermore, while conventional wellhead connectors are designed to provide a means for unlocking its latching mechanism from the wellhead it is desirable that a means be provided for forcibly extracting the latching mechanisms from their latching positions.

SUMMARY OF INVENTION

The present invention is a connector device for connecting a wellhead christmas tree assembly to a wellhead. The connector comprises a cylindrical body member which is provided with a plurality of lateral openings of uniform configuration arranged in equiangular orientation about the cylinder axis of the body member with the centers of the lateral openings residing in uniplanar relationship in a radial direction of the cylindrical axis of the body member. The connector includes a plurality of locking dogs, each of which is seated in a different one of said lateral openings and provided with a toothed front face having a configuration which conforms to the external configuration of the wellhead. The connector includes means for securing a wellhead christmas tree assembly to the upper end of the cylinder body member in coaxial relation thereto, a first drive means for driving the locking dogs to where the toothed faces of the locking dogs securely engage the wellhead and remain in locked condition therewith when the driving force is removed. The connector also includes a second drive means for forcibly moving the locking dogs away from engagement with the wellhead when it is desired to disconnect the wellhead christmas tree assembly from the wellhead.

DETAILED DESCRIPTION OF THE INVENTION

Figure 1:
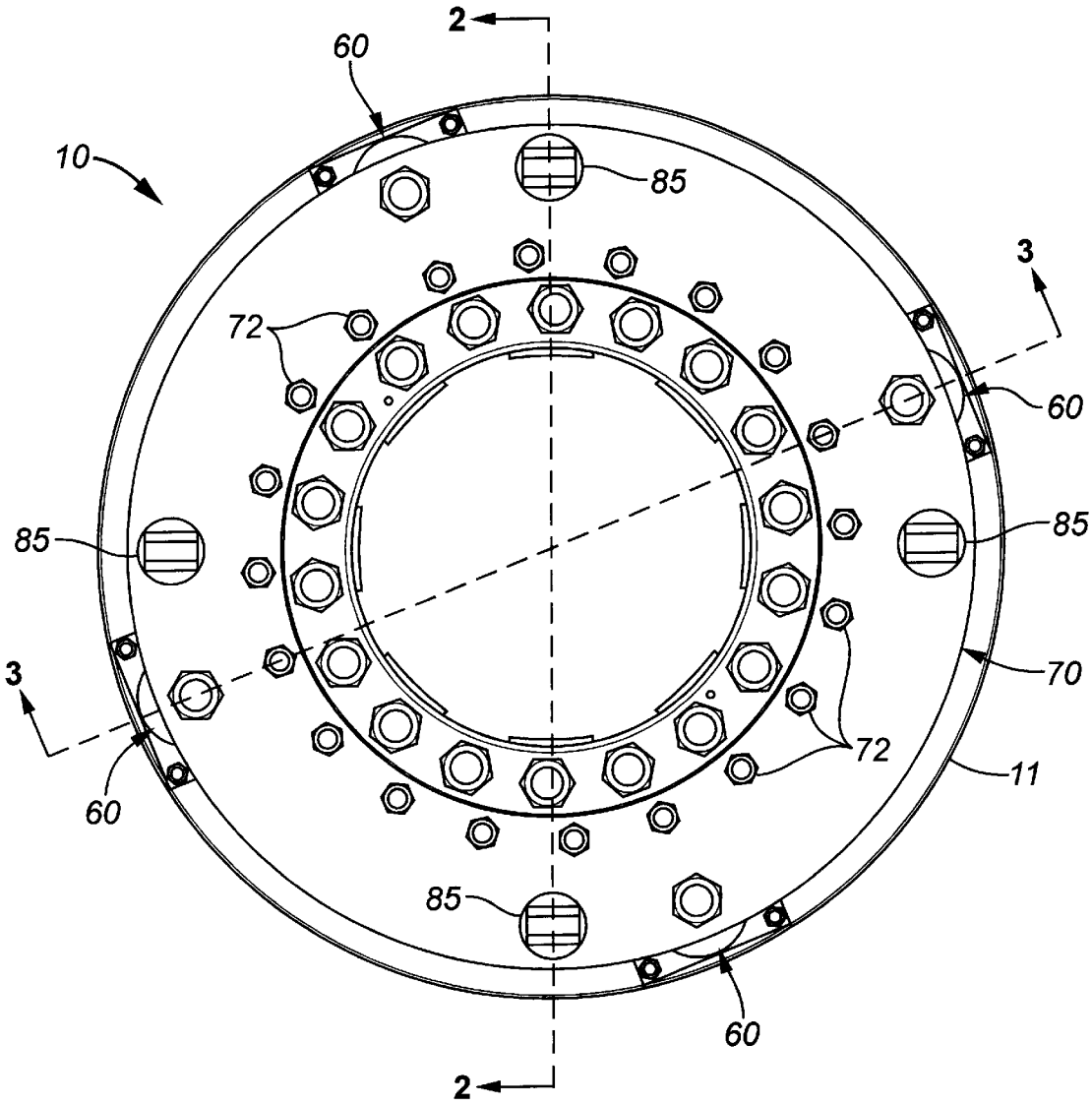
FIG. 1 is a top plan view of a connector device for connecting an oil well christmas tree assembly to a wellhead, and more particularly to a connector with tapered locking dogs for connecting an oil well distribution assembly, such as a christmas tree, to a wellhead.
Figure 2:
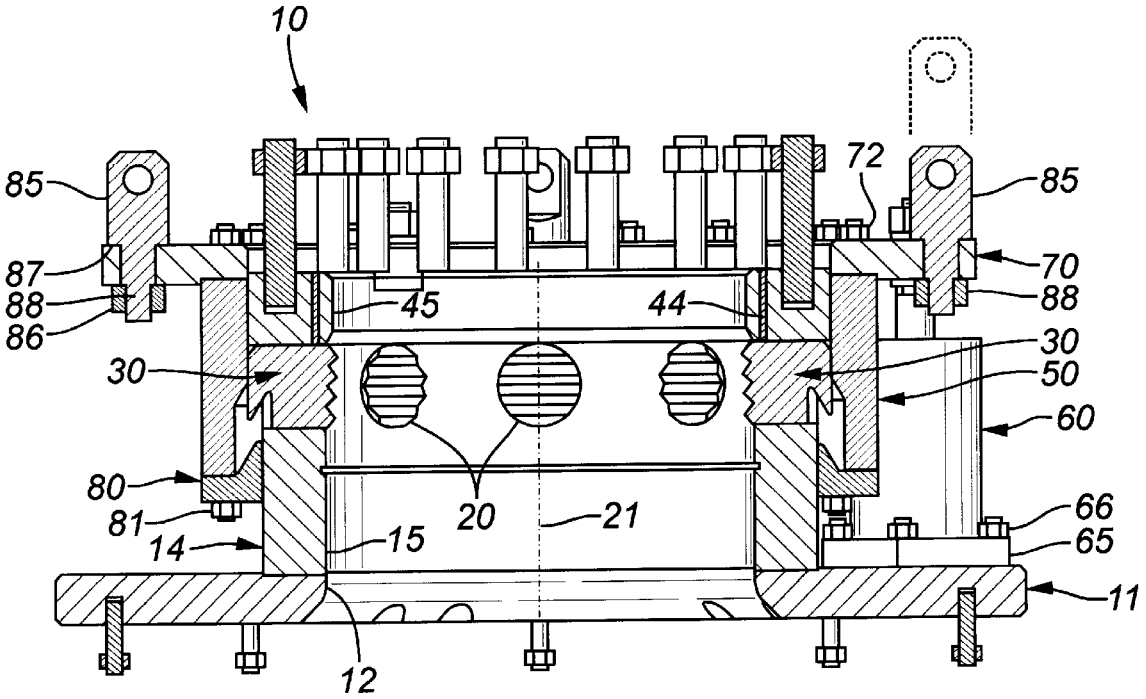
FIG. 2 is a section view of the connector device of the invention as taken along the section line 2—2 in FIG. 1.
Figure 12:
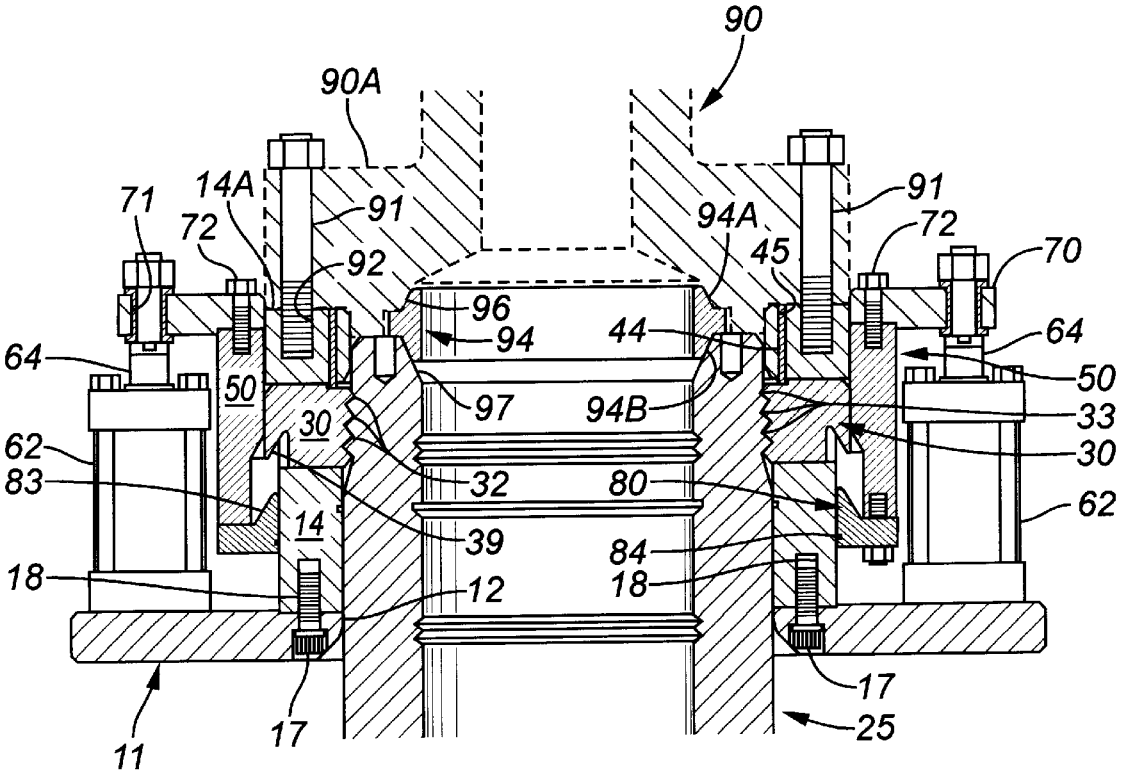
FIG. 12 is a diametrical section view showing the connector of the invention in a locked position on a wellhead.

Referring more particularly to the drawings, there is shown in FIG. 1, a plan view of a connector 10 which represents a preferred embodiment of the invention. The connector 10 includes an annular base plate 11 which in the section view of FIG. 2 is shown to be provided with a central circular opening 12, the diameter of which conforms to the outer diameter of the well pipe at the wellhead. The connector 10 includes a cylindrical body member 14 with an annular transverse cross-section and central opening 15 with a diameter which conforms to the diameter of the base plate opening 12. As seen in FIG. 12, the body 14 is secured to the base plate 11 in concentric coaxial alignment with the annular base plate 11 by means of a plurality of bolts 17 which extend through the base plate 11 into internally threaded blind bores 18 which are provided in the lower edge of the cylindrical body 14. The connector body 14 and base plate 11 are therefore adapted to be placed in sleeved coaxial relationship with the upper end of a wellhead, such as the wellhead 25 shown in FIG. 12.

Figure 4A:
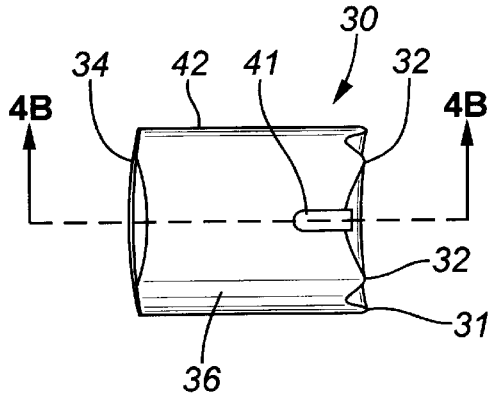
FIG. 4*a* is a top plan view of one of the locking dogs which is a component of the connector device of FIG. 1.
Figure 4B:
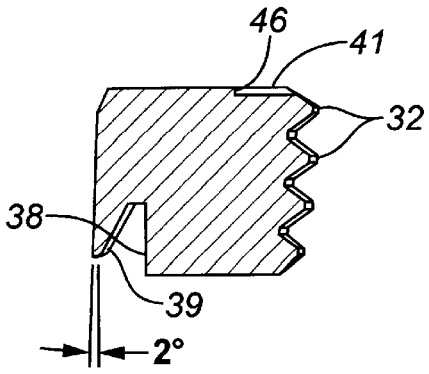
FIG. 4*b* is a section view of the locking dog of FIG. 4*a* as taken along the section line 4*b*—4*b* in FIG. 4*a;*
Figure 4C:
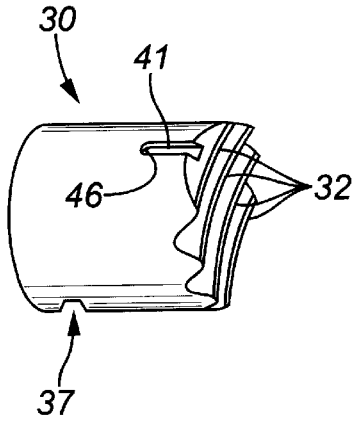
FIG. 4*c* is a perspective view of the locking dog shown in FIG. 4*a;*
Figure 5:
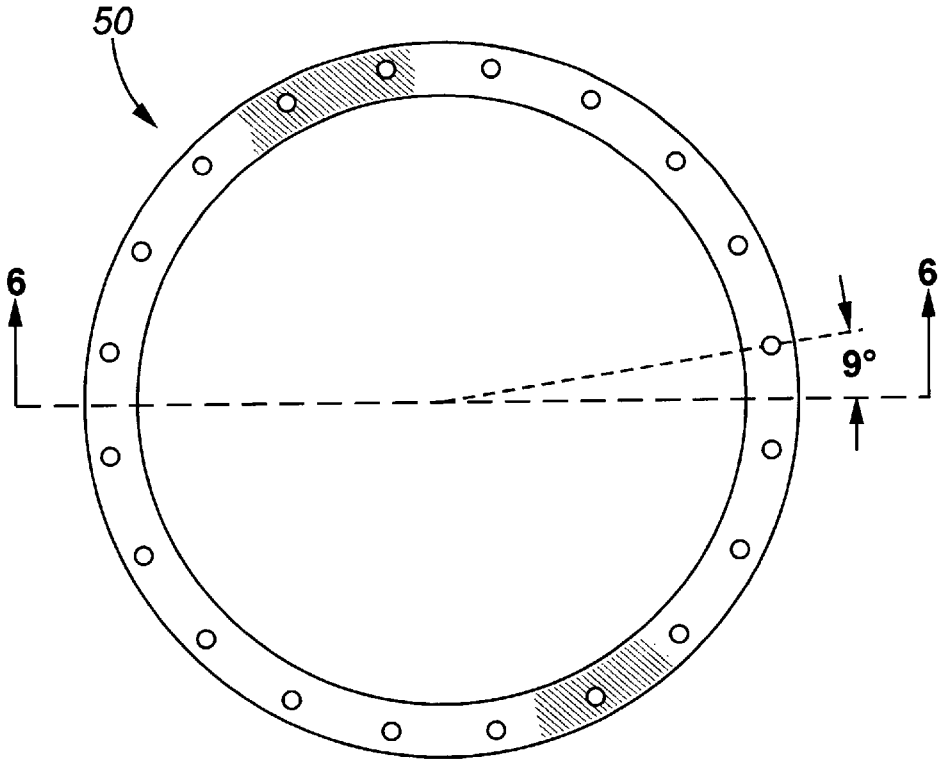
FIG. 5 is a top plan view of a locking sleeve which is a part of the connector device shown in FIG. 1.
Figure 6:
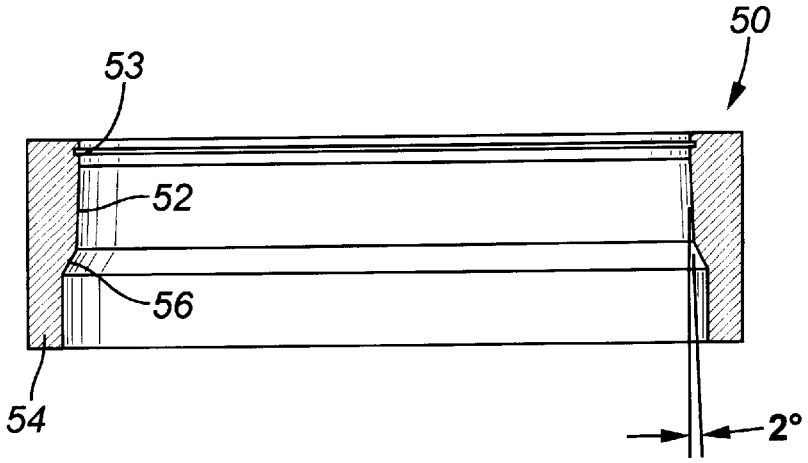
FIG. 6 is a section view of the locking sleeve as taken along the section line 6—6 in FIG. 5.
Figure 7:
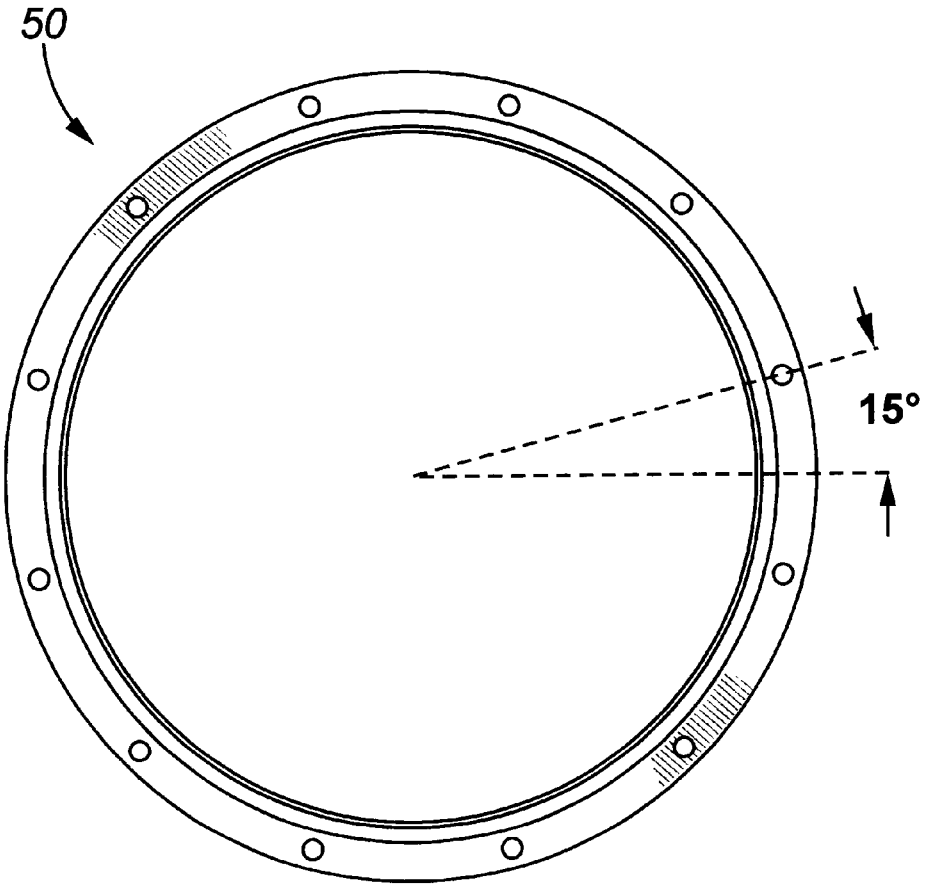
FIG. 7 is a bottom view of the locking sleeve shown in FIG. 5.

The cylindrical body 14 is also provided with a plurality of circular lateral openings 20 which are uniform in size and equidistant from the top end of the body 14. The openings 20 are also in uniform equiangular spacing about the central axis 21 of the cylindrical body 14. The lateral openings 20 are designed to accommodate a plurality of locking dogs 30, each of which is received in a different one of the openings 20. Each locking dog 30 as shown in FIGS. 4*a*, 4B and 4*c* is sized to be inserted in a lateral opening 20 and is provided with a transverse 20 cross section configured to form to the shape of the opening 20 such that the locking dog will fit snugly therein. On the front end 31 thereof which faces inwardly, the locking dog 20 is provided with a plurality of front face teeth 32 which are designed to mate with annular grooves 33 provided on the wellhead and thereby conform throughout their extent to the exterior of the wellhead.

On the other end, which is the outer face of the locking dog, it provided with a slightly curved surface 34, as seen in FIG. 4*a*, and which constitutes a portion of a frusto-conical surface which tapers outwardly, and as seen in FIG. 4*b*, tapers downwardly. The taper angle is 2°. Also in its cylindrical side wall 36, each locking dog 30 is provided with a radial groove 37 which provides a planar radial surface 38 and a tapered camming surface 39 having the configuration of a portion of a frusto-conical surface, which diverges outwardly and faces towards the front face of the locking dog. Also, on its side wall, each locking dog 30 is provided with an elongate slot 41 which extends a limited distance from its front face in the longitudinal direction of the locking dog.

It is also to be seen in FIG. 4*b*, that because of its tapered outer face 34, the length of the cylindrical side wall 36 is shorter than its length as measured at a location diametrically opposite therefrom. Accordingly, the slot 41 is formed in the side wall 36 in a linear direction along its shortest length 42 whereas the groove 37 is formed in the wall 36 to extend radially inward from its longest side length.

To keep the locking dogs from possibly falling into the wellhead during an installation or removal of a wellhead christmas tree assembly, a retaining means is provided for each locking dog by a plurality of retaining pins 44, each of which is inserted through an associated pin receiving bore 45 which is provided in the connector body 14 to extend from its upper edge 14*a* to a lateral opening 20 in the body 14. Each retaining pin 44 is of a length such that when inserted in its bore 45, part of the pin will project into the opening 20 and into the slot 41 in the side of the locking dog. When thus inserted, the locking dog 30 is correctly oriented for interaction of its outer tapered surface 34 with the camming surface 52 of a locking sleeve 50 to be hereinafter described. Also, the end of the slot 41 provides a stop shoulder 46 for the retaining pin 44 which would not normally engage the stop 46 in the locked or unlocked positions of the locking dogs.

Figure 3A:
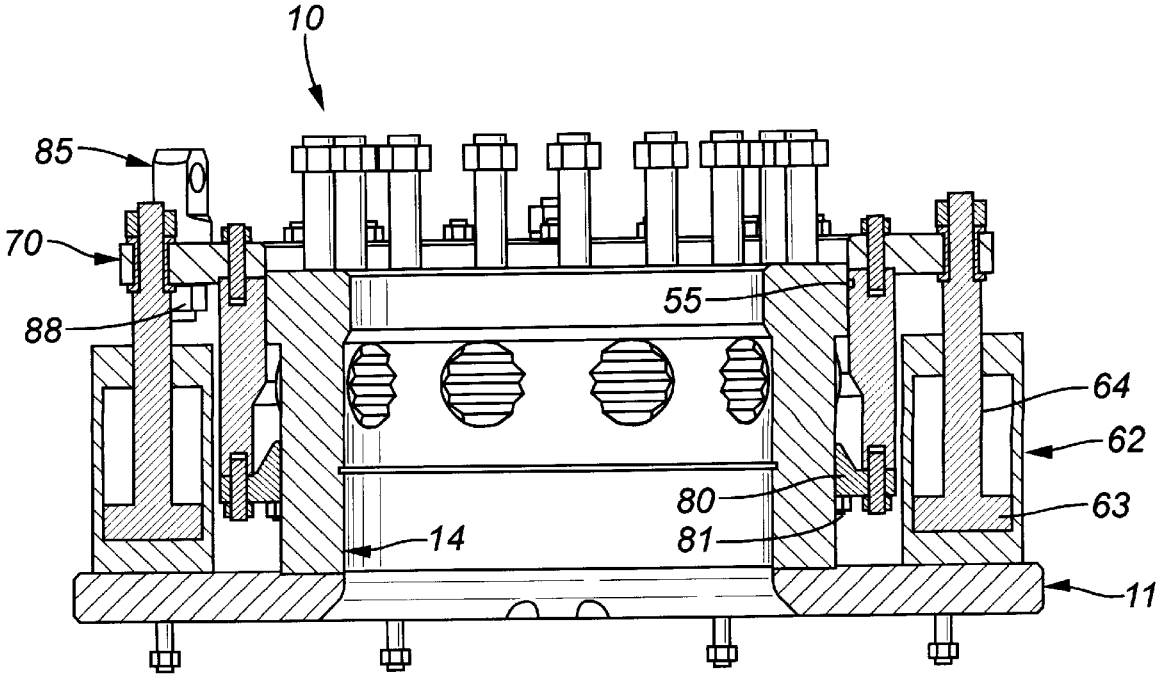
FIG. 3*a* is a section view of the connector device of the invention as taken along the section line 3—3 in FIG. 1.
Figure 8:
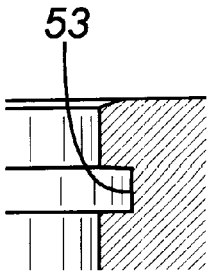
FIG. 8 is an enlarged sectional view of a fragmentary portion of the locking sleeve shown in FIG. 6.
Figure 9:
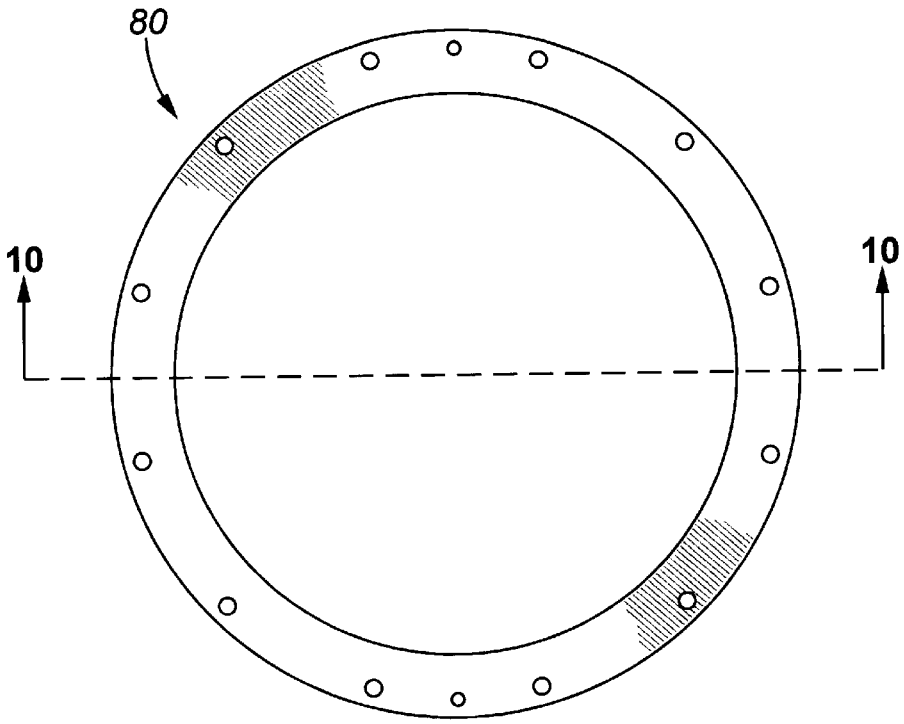
FIG. 9 is a top plan view of an unlocking sleeve which is a component of the connector device shown in FIG. 1.

The connector device 10 is also provided with a locking sleeve 50 having an annular transverse cross section which at one end, the upper end as seen in FIG. 2, is provided an inner diameter which is sufficient to allow its being closely sleeved about the cylindrical connector body 14. From one end, its upper end as seen in FIGS. 2 and 3*a*, and a limited distance therefrom, the locking dog is provided with an inner surface section in the configuration of a frusto-conical circular surface 52 with a 2° taper which is divergent in the direction toward the other end of the sleeve and matches the 2° taper provided on the rear faces of the locking dogs. At its other end the locking sleeve 50 is provided with a cylindrical inner surface portion 54 of circular cross section and a diameter which is greater than the largest inner diameter of the inner surface portion 52. The two surface portions 52, 54 are joined by an inner surface portion 56 of frusto-conical configuration which is provided with a taper angle of 30°. Near it's top edge, as seen in FIG. 8, the sleeve 50 is provided with an annular groove 53 which extends about its inner circumference and which is designed to receive an elastomer sealing ring 55 therein for sealing against the outer surface of the connector body 14.

As seen in FIGS. 2, 3*a* and 12 the locking sleeve is shown in its sleeved rotation to the connector body 14 and wherein its 2° taper surface 52 engages the outer tapered faces of the locking dogs 30 and has forced the locking dogs inwardly where as shown in FIG. 12, their toothed faces engage the grooved outer surface of a wellhead 25.

In order to position the locking sleeve as shown in FIGS. 2, 3*a* and 12 wherein the locking sleeve has forced the locking dogs inward, the connector device 10 is provided with a plurality of piston and cylinder assemblies 60, being four in number in the embodiment of the invention described herein. Each assembly 60 comprises a cylinder 62, a piston 63 and attached piston rod 64 which extends through one end of the cylinder in tightly sealed relationship therewith. As seen in FIG. 2, each cylinder 60 is provided with a radial flange 65 through which a number of bolts 66 are provided to secure the cylinder 62 to the base plate 11.

It is also to be seen that each cylinder 62 is mounted such that the piston and piston rod will move in an axial direction which is directly parallel to the central axes of the cylinder body 14 and the locking sleeve 50. The plurality of piston and cylinder assemblies 60 are mounted on the base plate 11 in equiangular spacing from one another and the piston rod of each assembly 60 is connected to an annular load plate 70 which is provided with an opening 71, each of which receives a piston rod 64 therethrough. Adjacent to its inner perimeter, the load plate 70 is provided with a number of bolts 72 which bolt the load plate to one end of the locking sleeve 50.

Figure 3B:
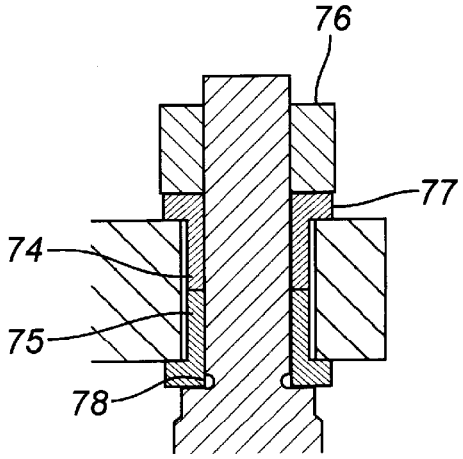
FIG. 3*b* is an enlarged fragmentary view showing details of connection of a piston rod to a load plate fixed to a locking sleeve component of the connector.

It is shown in FIG. 3*b* that a two part bushing comprising bushing parts 74,75 is placed in each of the openings 71 in sleeved relation to the piston rod 64. A clamping nut 76 is threaded onto the end of the piston rod and clamps a radial flange 77 of the bushing 74 against the lower bushing 75 which abuts a radial shoulder 78 on the piston rod. The two part bushing serves to distribute the load between the cylinder 60 and the top of the flange 77 to allow for "float" so that the piston can handle the high tolerances which are placed on it.

The piston and cylinder assembly 60, except for its connection with the load plate 70 is well known in the art. The inlet and outlet for the pressurized fluid which is selectively supplied to the cylinder 62 are not shown, but these may be provided by supply conduits which are provided in opposite ends of the cylinder 62 or which are designed to extend through the piston rod 64 and open into the cylinder chamber on opposite sides of the piston. By a conventional valving system, pressurized fluid can be delivered to the cylinder 62 to move the piston in a given direction as desired.

By simultaneously delivering fluid pressure from an appropriate source to each of the cylinders 62, the pistons 63 can be driven downwardly in synchronism. The pistons by means of their piston rod connections with the load plate 70 and its connection to the locking sleeve 50, causes the locking sleeve to move toward the base plate 11 and by engagement of its camming surface 52 with the tapered outer faces 34 of the locking dogs serves to drive the locking dogs into engagement with the external surface of the wellhead 25.

In order to provide means for releasing the locking dogs 30 from their locking engagement with the wellhead 25, an unlocking "kick out" ring 80 is provided which is bolted to the end of the locking sleeve 50 by bolts 81. The kick out ring 80 has an inner diameter which conforms to the diameter of the exterior surface of the connector body 14 against which it is disposed.

Figure 10:
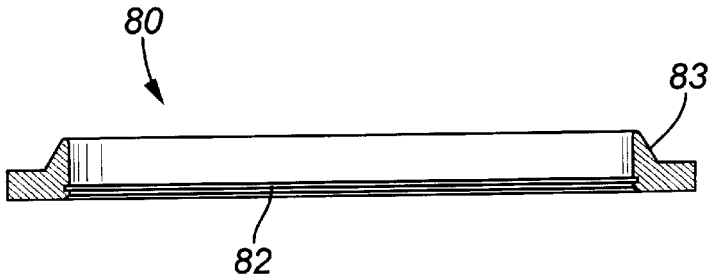
FIG. 10 is a section view of the unlocking sleeve as taken along the section line 10—10 in FIG. 9.
Figure 11:
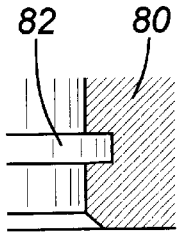
FIG. 11 is an enlarged fragmentary section view of a portion of the unlocking sleeve of FIG. 9.

As best seen in FIG. 10, the unlocking sleeve 80 is provided with an outward facing frusto-conical surface 83 which extends from one end of the sleeve 80 and diverges outwardly with a taper angle of 30° which matches the taper of the camming surface 39 on each of the locking dogs 30. On its inner surface near its bottom surface as seen in FIGS. 10 and 11 the ring 80 is provided with an annular groove 82 which accommodates an elastomer seal ring 84 for sealing against the connector body 14.

It is therefore to be noted that when pressurized fluid is delivered to the cylinders 62 to drive the pistons 63 in the upward direction as seen in the drawings, the unlocking sleeve 80 moves upwardly with the locking sleeve 50 and engages the locking dogs 30. By engagement of its camming surface 83 with the camming surfaces 39, the locking dogs 30 are forced out laterally away from the wellhead, thereby unlocking the connector 10 so the wellhead christmas tree assembly can be removed.

Should it become necessary, the connector device 10 is provided with override capability either manual or mechanical, by the provision of a plurality of lugs 85, the shafts 86 of which extend through holes provided in the load plate 70. Each lug 85 is fastened to the load plate by a nut 88 on the threaded end of the lug shaft 86 which clamps a radial shoulder 87 of the lug against the opposite surface of the load plate 70. In the event of a failure of the piston and cylinder assemblies to provide an actuating force, the actuating force can be applied to the lugs 85 to drive the load plate in a direction which actuates the locking dogs or in the opposite direction to unlock the locking dogs as may be desired.

In FIG. 12 the connector device 10 is shown installed atop the wellhead 25 in coaxial concentric relation thereto. The connector 10 is secured to a wellhead christmas tree 90 by a plurality of bolts 91 which extend through bolt holes provided in a lower radial flange 90*a* of the wellhead christmas tree and are threaded into internally threaded blind bores 92 which are found in the annular end surface 14*a* of the connector body 14. For insuring a fluid tight connection, an annular metal seal 94 of a material and construction well known in the art is seated such that its outward facing bevelled surfaces 94*a*, 94*b* engage conforming bevelled surfaces 96,97 which are provided at the junction of the inner surfaces of the christmas tree bore 98 and the wellhead bore 99.

Figure 13:
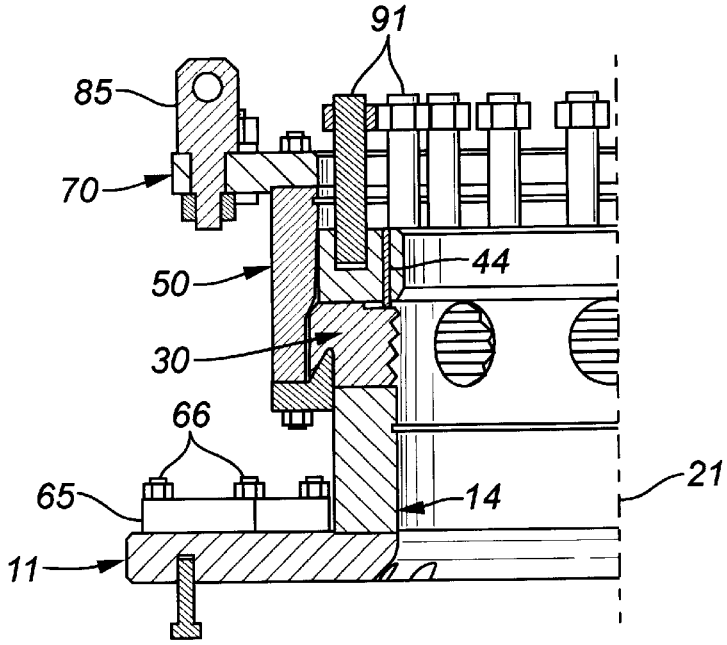
FIG. 13 is a fragmentary section showing the connector in its unlocked position.

In FIG. 13 the connector device 10 is shown as it appears in the unlocked condition with locking dogs retracted.

It is to be understood that the foregoing description of the invention has been presented for purposes of illustration and explanation and is not intended to limit the invention to the precise forms disclosed. For example, the lateral openings 20 in the connector body 14 could be other than circular such as a square configuration and the locking dogs provided with conforming square cross section. It is to be appreciated therefore that various material and structural changes may be made by those skilled in the art without departing from the spirit of the invention.

I claim:

1. A connector device for connecting a wellhead christmas tree assembly to a wellhead, said device comprising:

a cylindrical body member having a circular transverse cross section and an internal bore with a diameter conforming to the external diameter of the wellhead such that said body member can be sleeved about the wellhead, said cylindrical body member having a plurality of circular lateral openings extending transversely from the external surface of the cylindrical body member to the interior thereof, said openings being in equiangular spacing about the central axis of the cylindrical body member;

a locking sleeve having an annular cross section and an inner surface comprising a first surface portion of circular cylinder configuration extending from one end of the locking sleeve and having an internal diameter conforming to the external diameter of said cylindrical body member such that said locking sleeve can be sleeved about said body member, a second inner surface portion of circular cylinder configuration extending from the other end of the locking sleeve and having a greater diameter than said first inner surface portion, and an inwardly facing frusto-conical camming surface of a tapered configuration extending and tapering outwardly from the first inner surface portion towards the second inner surface portion of said locking sleeve;

a plurality of locking dogs equal in number to the circular lateral openings in said body member, each said locking dog having a transverse cross section sized and configured to conform to the shape of said circular lateral openings whereby each said locking dog can be inserted into a different one of said circular lateral openings, each said locking dog having an inner front face, a side wall and an outer rear face with the inner face having a plurality of projecting teeth providing a toothed surface conforming in configuration to the external surface of the wellhead and said outer face of the locking dog having an outward facing tapered surface which conforms to inwardly facing frusto-conical camming surface of the locking sleeve and is adapted to cooperably engageable therewith when the locking dog is inserted into one of said circular lateral openings with its inner toothed surface disposed to engage the external surface of the wellhead, and each said locking dog having in its side surface an arcuate shaped groove which provides an inward facing tapered camming surface which faces inwardly and is divergent outwardly;

piston means provided on said connector device for driving said locking sleeve in a selected axial direction comprising at least one piston and cylinder assembly having a piston and piston rod wherein the piston rod is fixed to the locking sleeve in parallel relation to the cylindrical axis of the locking sleeve and is movable in a vertically axial direction whereby when the piston means is actuated to drive the locking sleeve in a first axial direction, the camming surface of the locking sleeve engages the outer camming surfaces of the plurality of locking dogs to drive the locking dogs inwardly into locking engagement with the external surface of the wellhead;

an unlocking sleeve disposed in sleeved relationship about the lower external surface of the connector body member and fastened to the bottom end of the locking sleeve in coaxial relation therewith, said unlocking sleeve having an outwardly facing external camming surface portion of frusto-conical configuration convergent in the upward direction and adapted to cooperably engage with the inward facing camming surfaces of the plurality of locking dogs when said piston means is operated to drive the locking sleeve and unlocking sleeve in the axial direction to reverse to said first axial direction to thereby force the locking dogs outwardly from the wellhead and thereby unlock the connector from the wellhead; and means for fixedly securing a wellhead christmas tree assembly to the upper end of said cylindrical body.

2. A connector device as set forth in claim 1 wherein said piston means comprises a plurality of piston and cylinder assemblies, each of which is operatively associated with a source of fluid pressure and each of which comprises a piston and cylinder wherein the cylinder thereof is mounted on a base plate having a circular opening with a diameter of a size whereby said base plate may be sleeved about the wellhead, and each piston of which has a piston rod which extends from the cylinder and is fixedly secured to a circular load plate fixed to the top end of said locking sleeve whereby actuation of the piston and cylinder assemblies will drive the locking sleeve in an axial direction corresponding to the movement of said pistons to either lock or unlock the connector to the wellhead.

3. A connector device for connecting a wellhead christmas tree assembly to a wellhead, said device comprising:

a cylindrical body member having an annular transverse cross section and an internal bore with a diameter conforming to the external diameter of the wellhead such that said body member can be sleeved about the wellhead, said cylindrical body member having a plurality of circular lateral openings extending transversely from the external surface of the cylindrical body member to the interior thereof, said circular lateral openings being in equiangular spacing about the central axis of the cylindrical body member;

a plurality of locking dogs equal in number to the circular lateral openings in said body member, each said locking dog having a transverse cross section sized and configured to conform to the shape of said circular lateral openings whereby each said locking dog can be inserted into a different one of said circular lateral openings, each said locking dog having an inner said and an outer side with the inner side having a plurality of projecting teeth providing a toothed surface conforming in configuration to the external surface of the wellhead;

a first drive means on said connector device for driving each of said locking dogs inwardly into locking engagement with the external surface of the wellhead;

a second drive means on said connector device for driving the locking dogs outwardly from engagement with the wellhead to thereby unlock the connector device from the wellhead; and means for fixedly securing a wellhead christmas tree assembly to the upper end of said cylindrical body member.

4. A connector device as set forth in claim 3 wherein said first drive means comprises a locking sleeve having an annular section and an inner surface comprising a first surface portion of circular cylinder configuration extending from one end of the locking sleeve and having an internal diameter conforming to the external diameter of said cylindrical body member such that said locking sleeve can be sleeved about said body member, a second inner surface portion of circular cylinder configuration extending from the outer end of the locking sleeve and having a greater diameter than said first inner surface portion, and an inwardly facing camming surface of tapering configuration extending from the first inner surface portion towards the second inner surface portion of said locking sleeve, and wherein the outer side of each of the locking dogs is provided with an outwardly diverging and outward facing tapered surface conforming to the inwardly facing tapered camming surface of said locking sleeve and adapted to cooperably engageable therewith when the locking dog is inserted into one of said circular lateral openings with its inner toothed surface disposed to engage the external surface of the wellhead, and each said locking dog has in its said one end surface a circular groove which opens outwardly and provides an inward facing tapered camming surface which is divergent outwardly toward said one end whereby when a piston means is actuated to drive a piston rod and locking sleeve in the downward direction, the camming surface of the locking sleeve engages the outer camming surfaces of the plurality of locking dogs to drive the locking dogs inwardly into locking engagement with the external surface of the wellhead.

5. A connector device as set forth in claim 4 wherein said second drive means includes said locking sleeve and an unlocking sleeve disposed in sleeved relationship about the lower external surface of the cylindrical body member and fastened to the bottom end of the locking sleeve in coaxial relation therewith, said unlocking sleeve having an outwardly facing external camming surface portion of tapered configuration convergent in the direction towards said one end of the sleeve and adapted to cooperably engage with the inward facing camming surfaces of the plurality of locking dogs when said drive means is operated to drive the locking sleeve and the unlocking sleeve attached thereto in the axial direction away from said one end to thereby force the locking dogs outwardly from the wellhead and thereby unlock the connector from the wellhead.

6. A connector device as set forth in claim 1 wherein said cylindrical body and each said locking dog are provided with cooperable restraining means for limiting the inward movement of each locking dog when received in one of said circular lateral openings to prevent the locking dog from falling into the wellhead when the wellhead is not in a position to be engaged by the locking dogs.

7. A connector device as set forth in claim 6 wherein the cooperable restraining means is provided by each said locking dog having an inwardly directed grooved slot in its upper surface and said cylindrical body is provided with a plurality of bores of a size to tightly receive a restraining pin therethrough, each said bore extending downwardly from the top edge of the cylindrical body to a different one of the circular lateral openings in the cylindrical body and the restraining pin inserted therethrough projects into the grooved slot in the upper surface of the locking dog when the locking dog is inserted in a lateral opening in the cylindrical body to thereby prevent the possibility of the locking dog falling into the wellhead when the wellhead is not in a position to be engaged by the locking dogs.

8. A connector device as set forth in claim 1 wherein the tapered rear face of each said locking dog is provided with a taper which matches the taper of the inwardly facing camming surface of the locking sleeve and is sufficiently small such that when the actuating force to lockingly engage the locking dogs is removed the locking dogs will remain in their locking condition.

9. A connector device as set forth in claim 8 wherein the tapered rear face of each said locking dog is provided with a taper of approximately 2° and which matches the taper of the inwardly facing cam surface of the locking sleeve.

10. A connector device as set forth in claim 1 wherein each said piston rod is connected to an annular load plate which is fixed to the locking sleeve in concentric relation thereto, and the connection to the load plate is by means of the piston rod being extended through a two-part bushing in a piston rod accommodating opening provided in the load plate and being secured by a clamping nut on the end of the piston rod so as to distribute the load and allow the piston to accommodate manufacturing tolerances.

11. A connector device for connecting a wellhead christmas tree assembly to a wellhead, said device comprising:

a cylindrical body member having a circular transverse cross section and an internal bore with a diameter conforming to the external diameter of the wellhead such that said body member can be sleeved about the wellhead, said cylindrical body member having a plurality of lateral openings extending transversely from the external surface of the cylindrical body member to the interior thereof, said openings being in equiangular spacing about the central axis of the cylindrical body member;

a locking sleeve having an annular cross section and an inner surface comprising a first surface portion of circular cylinder configuration extending from one end of the locking sleeve and having an internal diameter conforming to the external diameter of said cylindrical body member such that said locking sleeve can be sleeved about said body member, a second inner surface portion of circular cylinder configuration extending from the other end of the locking sleeve and having a greater diameter than said first inner surface portion, and an inwardly facing frusto-conical camming surface of a tapered configuration extending and tapering outwardly from the first inner surface portion towards the second inner surface portion of said locking sleeve;

a plurality of locking dogs equal in number to the lateral openings in said body member, each said locking dog having a transverse cross section sized and configured to conform to the shape of said lateral openings whereby each said locking dog can be inserted into a different one of said lateral openings, each said locking dog having an inner front face, a side wall and an outer rear face with the inner face having a plurality of projecting teeth providing a toothed surface conforming in configuration to the external surface of the wellhead and said outer face of the locking dog having an outward facing tapered surface which conforms to inwardly facing frusto-conical camming surface of the locking sleeve and is adapted to cooperably engageable therewith when the locking dog is inserted into one of said lateral openings with its inner toothed surface disposed to engage the external surface of the wellhead, and each said locking dog having in its side surface an arcuate shaped groove which provides an inward facing tapered camming surface which faces inwardly and is divergent outwardly;

piston means provided on said connector device for driving said locking sleeve in a selected axial direction comprising at least one piston and cylinder assembly having a piston and piston rod wherein the piston rod is fixed to the locking sleeve in parallel relation to the cylindrical axis of the locking sleeve and is movable in a vertically axial direction whereby when the piston means is actuated to drive the locking sleeve in a first axial direction, the camming surface of the locking sleeve engages the outer camming surfaces of the plurality of locking dogs to drive the locking dogs inwardly into locking engagement with the external surface of the wellhead, wherein said piston means comprises a plurality of piston and cylinder assemblies, each of which is operatively associated with a source of fluid pressure and each of which comprises a piston and cylinder wherein the cylinder thereof is mounted on a base plate having a circular opening with a diameter of a size whereby said base plate may be sleeved about the wellhead, and each piston of which has a piston rod which extends from the cylinder and is fixedly secured to a circular load plate foxed to the top end of said locking sleeve whereby actuation of the piston and cylinder assemblies will drive the locking sleeve in an axial direction corresponding to the movement of said pistons to either lock or unlock the connector to the wellhead;

an unlocking sleeve disposed in sleeved relationship about the lower external surface of the connector body member and fastened to the bottom end of the locking sleeve in coaxial relation therewith, said unlocking sleeve having an outwardly facing external camming surface portion of frusto-conical configuration convergent in the upward direction and adapted to cooperably engage with the inward facing camming surfaces of the plurality of locking dogs when said piston means is operated to drive the locking sleeve and unlocking sleeve in the axial direction to reverse to said first axial direction to thereby force the locking dogs outwardly from the wellhead and thereby unlock the connector from the wellhead; and means for fixedly securing a wellhead christmas tree assembly to the upper end of said cylindrical body.

12. A connector device for connecting a wellhead christmas tree assembly to a wellhead, said device comprising:

a cylindrical body member having a circular transverse cross section and an internal bore with a diameter conforming to the external diameter of the wellhead such that said body member can be sleeved about the wellhead, said cylindrical body member having a plurality of lateral openings extending transversely from the external surface of the cylindrical body member to the interior thereof, said openings being in equiangular spacing about the central axis of the cylindrical body member;

a locking sleeve having an annular cross section and an inner surface comprising a first surface portion of circular cylinder configuration extending from one end of the locking sleeve and having an internal diameter conforming to the external diameter of said cylindrical body member such that said locking sleeve can be sleeved about said body member, a second inner surface portion of circular cylinder configuration extending from the other end of the locking sleeve and having a greater diameter than said first inner surface portion, and an inwardly facing frusto-conical camming surface of a tapered configuration extending and tapering outwardly from the first inner surface portion towards the second inner surface portion of said locking sleeve;

a plurality of locking dogs equal in number to the lateral openings in said body member, each said locking dog having a transverse cross section sized and configured to conform to the shape of said lateral openings whereby each said locking dog can be inserted into a different one of said lateral openings, each said locking dog having an inner front face, a side wall and an outer rear face with the inner face having a plurality of projecting teeth providing a toothed surface conforming in configuration to the external surface of the wellhead and said outer face of the locking dog having an outward facing tapered surface which conforms to inwardly facing frusto-conical camming surface of the locking sleeve and is adapted to cooperably engageable therewith when the locking dog is inserted into one of said lateral openings with its inner toothed surface disposed to engage the external surface of the wellhead, and each said locking dog having in its side surface an arcuate shaped groove which provides an inward facing tapered camming surface which faces inwardly and is divergent outwardly, and wherein the tapered rear face of each said locking dog is provided with a taper which matches the taper of the inwardly facing camming surface of the locking sleeve and is sufficiently small such that when the actuating force to lockingly engage the locking dogs is removed the locking dogs will remain in their locking condition, further wherein the tapered rear face of each said locking dog is provided with a taper of approximately 2° and which matches the taper of the inwardly facing cam surface of the locking sleeve;

piston means provided on said connector device for driving said locking sleeve in a selected axial direction comprising at least one piston and cylinder assembly having a piston and piston rod wherein the piston rod is fixed to the locking sleeve in parallel relation to the cylindrical axis of the locking sleeve and is movable in a vertically axial direction whereby when the piston means is actuated to drive the locking sleeve in a first axial direction, the camming surface of the locking sleeve engages the outer camming surfaces of the plurality of locking dogs to drive the locking dogs inwardly into locking engagement with the external surface of the wellhead;

an unlocking sleeve disposed in sleeved relationship about the lower external surface of the connector body member and fastened to the bottom end of the locking sleeve in coaxial relation therewith, said unlocking sleeve having an outwardly facing external camming surface portion of frusto-conical configuration convergent in the upward direction and adapted to cooperably engage with the inward facing camming surfaces of the plurality of locking dogs when said piston means is operated to drive the locking sleeve and unlocking sleeve in the axial direction to reverse to said first axial direction to thereby force the locking dogs outwardly from the wellhead and thereby unlock the connector from the wellhead; and means for fixedly securing a wellhead christmas tree assembly to the upper end of said cylindrical body.

13. A connector device for connecting a wellhead christmas tree assembly to a wellhead, said device comprising:

a cylindrical body member having a circular transverse cross section and an internal bore with a diameter conforming to the external diameter of the wellhead such that said body member can be sleeved about the wellhead, said cylindrical body member having a plurality of lateral openings extending transversely from the external surface of the cylindrical body member to the interior thereof, said openings being in equiangular spacing about the central axis of the cylindrical body member;

a locking sleeve having an annular cross section and an inner surface comprising a first surface portion of circular cylinder configuration extending from one end of the locking sleeve and having an internal diameter conforming to the external diameter of said cylindrical body member such that said locking sleeve can be sleeved about said body member, a second inner surface portion of circular cylinder configuration extending from the other end of the locking sleeve and having a greater diameter than said first inner surface portion, and an inwardly facing frusto-conical camming surface of a tapered configuration extending and tapering outwardly from the first inner surface portion towards the second inner surface portion of said locking sleeve;

a plurality of locking dogs equal in number to the lateral openings in said body member, each said locking dog having a transverse cross section sized and configured to conform to the shape of said lateral openings whereby each said locking dog can be inserted into a different one of said lateral openings, each said locking dog having an inner front face, a side wall and an outer rear face with the inner face having a plurality of projecting teeth providing a toothed surface conforming in configuration to the external surface of the wellhead and said outer face of the locking dog having an outward facing tapered surface which conforms to inwardly facing frusto-conical camming surface of the locking sleeve and is adapted to cooperably engageable therewith when the locking dog is inserted into one of said lateral openings with its inner toothed surface disposed to engage the external surface of the wellhead, and each said locking dog having in its side surface an arcuate shaped groove which provides an inward facing tapered camming surface which faces inwardly and is divergent outwardly, and wherein the tapered rear face of each said locking dog is provided with a taper which matches the taper of the inwardly facing camming surface of the locking sleeve and is sufficiently small such that when the actuating force to lockingly engage the locking dogs is removed the locking dogs will remain in their locking condition;

piston means provided on said connector device for driving said locking sleeve in a selected axial direction comprising at least one piston and cylinder assembly having a piston and piston rod wherein the piston rod is fixed to the locking sleeve in parallel relation to the cylindrical axis of the locking sleeve and is movable in a vertically axial direction whereby when the piston means is actuated to drive the locking sleeve in a first axial direction, the camming surface of the locking sleeve engages the outer camming surfaces of the plurality of locking dogs to drive the locking dogs inwardly into locking engagement with the external surface of the wellhead, and further wherein each said piston rod is connected to an annular load plate which is fixed to the locking sleeve in concentric relation thereto, and the connection to the load plate is by means of the piston rod being extended through a two-part bushing in a piston rod accommodating opening provided in the load plate and being secured by a clamping nut on the end of the piston rod so as to distribute the load and allow the piston to accommodate manufacturing tolerances;

an unlocking sleeve disposed in sleeved relationship about the lower external surface of the connector body member and fastened to the bottom end of the locking sleeve in coaxial relation therewith, said unlocking sleeve having an outwardly facing external camming surface portion of frusto-conical configuration convergent in the upward direction and adapted to cooperably engage with the inward facing camming surfaces of the plurality of locking dogs when said piston means is operated to drive the locking sleeve and unlocking sleeve in the axial direction to reverse to said first axial direction to thereby force the locking dogs outwardly from the wellhead and thereby unlock the connector from the wellhead; and means for fixedly securing a wellhead christmas tree assembly to the upper end of said cylindrical body.

* * * * *